United States Patent [19]

Reeder

[11] 4,139,844

[45] Feb. 13, 1979

[54] SURVEILLANCE METHOD AND SYSTEM WITH ELECTROMAGNETIC CARRIER AND PLURAL RANGE LIMITING SIGNALS

[75] Inventor: Willes W. Reeder, Fort Lauderdale, Fla.

[73] Assignee: Sensormatic Electronics Corporation, Deerfield, Fla.

[21] Appl. No.: 840,240

[22] Filed: Oct. 7, 1977

[51] Int. Cl.[2] ..... G08B 13/18

[52] U.S. Cl. ..... 340/572; 343/6.8 R

[58] Field of Search ..... 340/572; 343/6.8 R, 343/6.8 LC

[56] References Cited

U.S. PATENT DOCUMENTS 3,707,711 12/1972 Cole et al. ..... 340/572

3,895,368 7/1975 Gordon et al. ..... 340/572

*Primary Examiner*—Glen R. Swann, III

*Attorney, Agent, or Firm*—Watson, Leavenworth, Kelton & Taggart

[57] ABSTRACT

A microwave carrier signal is transmitted throughout a surveillance field. Two low frequency signals are also radiated into the field from opposite sides to limit the field size. A miniature receptor-reradiator containing a nonlinear signal mixing device responds to the signals when in the field to return a modulated carrier signal to a receiver device for actuating an alarm. The alarm is actuated only when the receiver detects a signal having a carrier component corresponding to the microwave signal with sideband components corresponding to the sum of the frequencies of the two low frequency signals.

9 Claims, 4 Drawing Figures

SURVEILLANCE METHOD AND SYSTEM WITH ELECTROMAGNETIC CARRIER AND PLURAL RANGE LIMITING SIGNALS

BACKGROUND OF THE INVENTION

The present invention relates to a method and apparatus for pilferage control. More particularly, it is directed to a method and apparatus for detecting the presence of a telltale element in an unauthorized zone.

In U.S. Pat. No. 3,895,368 issued July 15, 1975, for "Surveillance System and Method Utilizing Both Electrostatic and Electromagnetic Fields" and assigned to the same assignee as the present application, there is described a system with respect to which the present invention represents a significant improvement. Said patent describes a system wherein a microwave signal generator projects an electromagnetic wave into a space under surveillance to establish a first field. A pulse or frequency modulated low frequency generator is used to apply a voltage to a discontinuous conductor for establishing a second field, electrostatic in nature, throughout the space. Presence in the space of a miniature passive electromagnetic wave receptor-reradiator in the form of a semiconductive diode connected to a dipole antenna causes the reradiation of a low frequency component modulated on a microwave component as a carrier. The front end of a receiver system is tuned to the microwave frequency and feeds a suitable detector circuit responsive to the low frequency signal. A coincidence circuit energizes an alarm circuit whenever the detected signal coincides with the original modulation envelope being applied to the low frequency generator.

While said patented system represented a marked advance over the art then extant, it has been found to have certain limitations. In a typical installation, the electromagnetic and electrostatic fields are radiated from pedestals located on opposite sides of a doorway or exitway from an area to be supervised. The most common usage is to prevent pilferage from retail stores. In such case it is important that the surveillance zone be restricted to a small region proximate to the exit and prevented from overreaching or overranging into areas wherein it is desired to display merchandise or where normal traffic with unsold merchandise might take place. The usual radiation pattern from each pedestal constructed in accordance with the patented system is approximately circular centered around said pedestal. In order to cover the space between the pedestals, each pedestal must have a range at least greater than half the distance therebetween. However, while the pedestal has a range in front toward the opposite pedestal, it also has a range behind. It is the rear and lateral output or overranging that is undesirable and that is avoided by the present invention.

SUMMARY OF THE INVENTION

With the foregoing in mind, the present invention has for its object to provide a method for detecting the presence in a controlled space of an electric signal receptor-reradiator which is superior to any method heretofore known. In accordance with one aspect of the present invention there is provided a method of maintaining surveillance within a confined space to detect the presence in said space of an electric signal receptor-reradiator with signal mixing capability, said method comprising the steps of simultaneously establishing in said space first, second and third energy fields. The first field is electromagnetic in nature and produced by a microwave signal for causing said receptor-reradiator to return a signal therefrom. The second and third fields are established, respectively, from locations on opposite sides of the space with sufficiently low frequencies to restrict the range of the corresponding field substantially to the distance between said locations. Detection in the space of a signal consisting of a carrier component due to said first field and a modulation component due to mixing of said second and third fields is indicative of the presence of the receptor-reradiator therein.

In accordance with another aspect of the present invention, there is provided a surveillance system for detecting the presence in a controlled space of a receptor-reradiator of the foregoing type, said system comprising in combination a source of continuous microwave signals, means coupled to said source of microwave signals for propagating through said space an electromagnetic wave corresponding to said microwave signals, a first source of low frequency signals having a first average frequency, a second source of low frequency signals having a second average frequency different from said first average frequency, means coupled to said sources of low frequency signals for establishing respective wave fields corresponding to said low frequency signal through corresponding regions, each including said space, said low frequency signals having a sufficiently low frequency to enable the overlapping regions of said wave fields to be confined substantially to a smaller volume than said microwave signals, said smaller volume defining said space, signal detecting means, means for coupling said detecting means with said space for receiving signals therefrom, said detecting means being constructed and arranged to detect a third signal having an average frequency different from said first and second average frequencies and from harmonics thereof, said third signal being a modulation product resulting from mixing said first and second low frequency signals, and said detecting means detecting said third signal only when it is received as modulation on a carrier signal whose frequency bears a predetermined relationship to that of said microwave signals, and means coupled to said detecting means for providing an alarm responsive to detection of said third signal.

BRIEF DESCRIPTION OF THE DRAWINGS

The invention will be better understood after reading the following detailed description of the presently preferred embodiment thereof with reference to the appended drawings in which.

The same reference numerals are used throughout the various figures of the drawings to designate the same or similar parts.

DESCRIPTION OF THE PREFERRED EMBODIMENT

Figure 1:
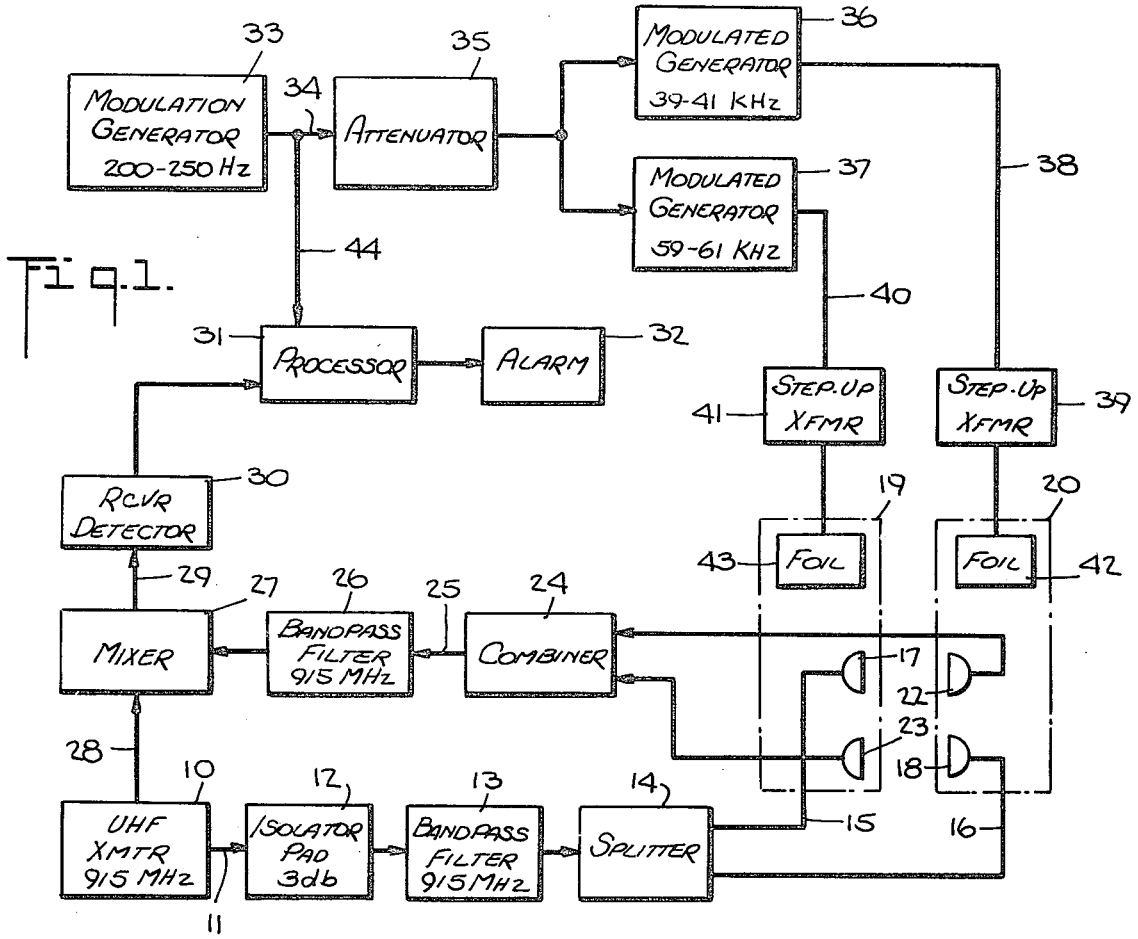
FIG. 1 is a block diagram of a surveillance system constructed in accordance with the invention.

Referring now to FIG. 1, an ultrahigh frequency transmitter 10 operating at 915 MHz functions as a source of microwave signals and has its output connected over path 11 through a 3db isolator pad 12 and a bandpass filter 13 to the splitter 14. The bandpass filter 13 has a center frequency of 915 MHz. The splitter 14 has two outputs connected over paths 15 and 16 to individual antenna elements 17 and 18, respectively. The antenna elements 17 and 18 should be mounted on opposite sides of the area to be controlled in corresponding enclosures or pedestals such as those represented by the broken line boxes 19 and 20. In this manner, the two antenna elements 17 and 18 establish an electromagnetic field of microwave energy in the controlled space therebetween. See, for example, FIG. 2 wherein said pedestals 19 and 20 are placed on opposite sides of a doorway 21.

A second pair of antenna elements 22 and 23 are mounted across the controlled space from the corresponding transmitter antenna elements 17 and 18, respectively. As shown, this places antenna element 22 in pedestal 20 and antenna element 23 in pedestal 19. The signals received from the space by antenna elements 22 and 23 are fed over corresponding paths to the two inputs of a combiner element 24 whose common output is fed over path 25 through a bandpass filter 26 to one input of a balanced mixer 27. The second input of the balanced mixer 27 is furnished with a signal at 915 MHz derived from a low power level output of the transmitter 10 over path 28. The bandpass filter 26 has a center frequency of 915 MHz.

The output from the balanced mixer 27 is fed over path 29 to the receiver detector 30 whose output is fed to the input of a processor 31. The output from processor 31 is connected to an alarm circuit 32.

A modulation generator 33 operating at selectable rates between 200 and 250 Hz has its output connected over a path 34 to an attenuator 35 whose output is fed in parallel to the controlling inputs of two modulated generators 36 and 37. As described in the aforesaid patent, the modulation generator 33 may be a voltage-controlled multivibrator pulse generator while each of the modulated generators 36 and 37 may be a combination of a voltage-controlled multivibrator pulse generator, a low pass filter, and a power amplifier.

The generator 36 has a center frequency of 40 KHz; while the generator 37 has a center frequency of 60 KHz. In response to the control received through attenuator 35 from generator 33, the frequency of generator 36 is shifted ± 1 Khz between 39 KHz and 41 KHz. In similar manner the frequency of generator 37 is shifted ± 1 KHz between 59 KHz and 61 KHz. The frequencies of generators 36 and 37 are shifted in phase such that generator 37 is operating at 59 KHz when generator 36 is operating at 39 KHz and generator 37 is at 61 KHz when generator 36 is at 41 KHz. The output from generator 36 is connected over a path 38 to a step-up transformer 39 while the output from generator 37 is connected over a path 40 to a step-up transformer 41. The secondary windings (not shown) of the transformer 39 and 41 are connected to apply voltage to the foil elements 42 and 43 associated, respectively, with each of the pedestals 20 and 19. The foils constitute a special form of discontinuous conductor. The signals fed to the foils 42 and 43 establish electrostatic fields between the respective foils and ground, i.e., a point of reference potential.

A second path 44 conducts the output of the generator 33 to another input to the processor 31. The details of the processor do not form a part of the present invention and may consist of the NAND gates, counter, pulse stretcher, delay multivibrator, and reference pulse multivibrator arrangement described in the aforesaid patent with reference to the embodiment of FIG. 4 thereof.

Figure 2:
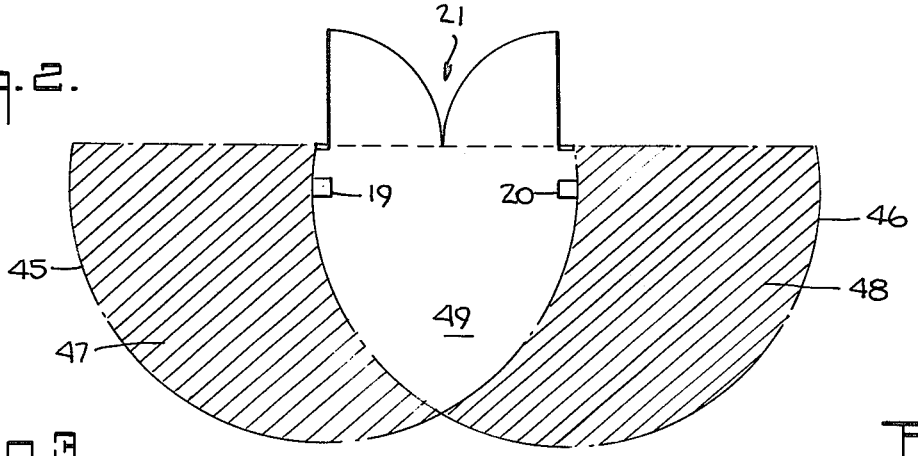
FIG. 2 is a diagram illustrating the relationship of a pair of surveillance pedestals to a doorway area to be protected.
Figure 3:
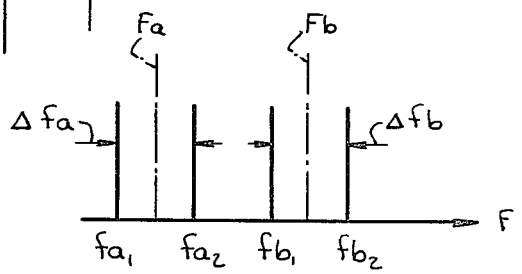
FIG. 3 is a frequency diagram illustrating the signal frequencies for creating the low frequency fields.
Figure 4:
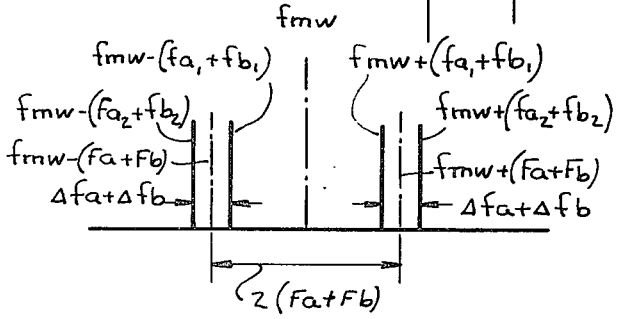
FIG. 4 is a frequency diagram illustrating the frequencies present on the modulated microwave carrier as reflected from a receptor-reradiator to be detected.

The operation of the present system is similar to that of the system of FIG. 4 described in the aforesaid patent. The differences in operation will now be described with reference to FIGS. 1 to 4 of the present application. In general a microwave signal at 915 MHz is radiated from each of the pedestals 19 and 20, the range of which exceeds the desired surveillance zone. However, as explained in the aforesaid patent, the use of a low frequency source energizing a discontinuous conductor to produce an electrostatic field produces a restricted zone of coverage for the system. As seen in FIG. 2 of the present application, the pedestal 19 may be assumed to cover a zone bounded by the broken line 45, while the pedestal 20 may cover a zone bounded by the broken line 46. The radius of each of the zones 45 and 46 is such as to extend at least to the opposite pedestal. With the system described in the aforesaid patent, the sensitivity zone of the system would include the shaded areas 47 and 48 as well as the central area 49. The present invention, as will be explained hereinafter, eliminates sensitivity in the zones 47 and 48 restricting the detection to the zone 49.

Still referring to FIG. 2, the zone 49 contains three electric fields, one produced by the output of antennas 17 and 18 at microwave frequency, one produced by foil 42 in pedestal 20 and one produced by foil 43 in pedestal 19. The last two fields are distinguished by different bands of frequencies. FIG. 3 illustrates the relative relationship of the various frequencies as produced by the foils 42 and 43. The electrostatic fields are characterized by said frequencies. If F*a* represents the center frequency of generator 36 and F*b* represents the center frequency of generator 37, the other frequencies should be self-evident. That is, $fa_1$ represents the lower frequency, $fa_2$ represents the upper frequency, and $\Delta fa$ represents the width of the frequency band of generator 36, In similar manner, the output of generator 37 has its lower frequency represented by $fb_1$, its upper frequency represented by $fb_2$, and its bandwidth by $\Delta fb$. While the generators 36 and 37 are described as having a center frequency, the modulation envelope may be in the form of a square wave with the outputs from generators 36 and 38 being switched abruptly between their respective upper and lower frequency levels.

The characteristic of the receptor-reradiator is such that it causes mixing of the signals present in the zone 49. Thus, the reradiated signal will have a frequency spectrum represented, in part, by the frequencies shown on the frequency chart of FIG. 4. Said chart is limited to the upper and lower sidebands corresponding to the sum of the frequencies obtained from the two generators 36 and 37. While other sidebands will be present, they are sufficiently remote from the sidebands of interest to be ignored. The passband of the receiver and the detector circuit is such as to restrict the response of the circuit to those sideband frequencies corresponding to the aforesaid sum of the frequencies from generators 36 and 37. The relationship of the frequencies should be self-evident from a comparison of the symbols appearing on FIG. 4 with those appearing in FIG. 3. The frequency of the microwave carrier is indicated by fmw.

Referring to FIG. 2, if it can be assumed that, for example, the range of pedestal 20 is limited to the boundary 46, a receptor-reradiator outside of said boundary may either return no detectable signal level corresponding to generator 36 or, if a receptor-reradiator is within the zone 47, the sidebands on the microwave carrier will be limited to those due to generator 37. However, receiver detector 30 is designed to respond only to frequencies corresponding to the sum frequency of the outputs from generators 36 and 37. In the particular example where the center frequency of generator 36 is 40 KHz and the center frequency of generator 37 is 60 KHz, the sum will be 100 KHz. Thus, receiver detector 30 is designed to pass only frequencies centered around 100 KHz over approximately a 4 KHz wide band. It should be apparent that if generators 36 and 37 are pulse modulated in phase as described above, the sum frequency will shift abruptly between 98 KHz and 102 KHz, i.e., $(fa_1+fb_1)$ and $(fa_2+fb_2)$ or (39 + 59) and (41 + 61).

It should now be understood that processor 31 will energize alarm 32 only when a signal from receiver detector 30 resulting from detection of a frequency corresponding to the sum of the outputs from generators 36 and 37 has a wave envelope matching the output of modulation generator 33. For further explanation of this aspect of the operation of the circuit the reader is referred to the aforesaid patent the disclosure of which is incorporated herein by reference.

It is not believed that the center frequencies illustrated for generators 36 and 37 are critical. However, they should be selected such that the various harmonics thereof do not coincide with the frequency passband of receiver detector 30. Thus, for example, center frequencies of 33 KHz and 67 KHz should be avoided since the third harmonic of the lower frequency would be approximately equal to the sum of the two frequencies, namely, 100 KHz, and would cause false triggering of the alarm. Preferably, the frequencies should be selected such that their harmonics are displaced as far as possible from the sum of the fundamentals.

Having described the presently preferred embodiment of the invention it should be understood that various changes in construction and arrangement will be apparent to those skilled in the art and are fully contemplated herein without departing from the true spirit of the invention as defined in the appended claims.

What is claimed is:

1. The method of maintaining surveillance within a confined space to detect the presence in said space of an electric signal receptor-reradiator with signal mixing capability, said method comprising the steps of simultaneously establishing in said space first, second and third energy fields, said first field being electromagnetic in nature and produced by a microwave signal for causing said receptor-reradiator to return a signal therefrom, said second and third fields being established respectively from locations on opposite sides of said space with sufficiently low frequencies to restrict the range of the corresponding field substantially to the distance between said locations, and detecting the presence in said space of a signal consisting of a carrier component due to said first field and a modulation component due to mixing of said second and third fields.

2. The method according to claim 1, wherein said second and third fields are produced with frequency modulated signals.

3. The method according to claim 1, wherein said modulation component has a frequency which corresponds to the sum of the frequencies of the signals establishing said second and third fields.

4. A surveillance system for detecting the presence in a controlled space of a miniature passive electromagnetic wave receptor-reradiator with signal mixing capability, said system comprising in combination a source of continuous microwave signals, means coupled to said source of microwave signals for propagating through said space an electromagnetic wave corresponding to said microwave signals, a first source of low frequency signals having a first average frequency, a second source of low frequency signals having a second average frequency different from said first average frequency, a first discontinuous conductor coupled to said first source of low frequency signals for establishing through a first region including said space an electrostatic field corresponding to said first low frequency signals, a second discontinuous conductor coupled to said second source of low frequency signals for establishing through second region, different from said first region but including said space, an electrostatic field corresponding to said second low frequency signals, said low frequency signals having a sufficiently low frequency to enable the overlapping regions of said electrostatic fields to be confined substantially to a smaller volume than said microwave signals, said smaller volume defining said space, signal detecting means, means for coupling said detecting means with said space for receiving signals therefrom, said detecting means being constructed and arranged to detect a third signal having an average frequency different from said first and second average frequencies and from harmonics thereof, said third signal being a modulation product resulting from mixing said first and second low frequency signals, and said detecting means detecting said third signal only when it is received as modulation on a carrier signal whose frequency bears a predetermined relationship to that of said microwave signals, and means coupled to said detecting means for providing an alarm responsive to detection of said third signal.

5. A surveillance system according to claim 4, wherein means are coupled to both said first and second source of low frequency signals for frequency modulating said low frequency signals.

6. A surveillance system according to claim 4, wherein means are coupled to both said first and second source of low frequency signals for frequency modulating simultaneously and in phase said low frequency signals, and said means for providing an alarm are coupled to said frequency modulating means for providing said alarm only when the detected third signal is frequency modulated with a wave envelope having the same general shape as said modulating signal.

7. A surveillance system according to claim 4, wherein means are coupled to both said first and second source of low frequency signals for frequency modulating said low frequency signals such that said first low frequency signals vary between frequencies $fa_1$ and $fa_2$ and said second low frequency signals vary simultaneously in phase respectively between frequencies $fb_1$ and $fb_2$, and said third signal has a frequency which varies in phase with said first and second low frequency signals between $(fa_1 + fb_1)$ and $(fa_2 + fb_2)$.

8. A surveillance system according to claim 4, wherein said first average frequency is about 40 KHz, said second average frequency is about 60 KHz, and said third average frequency is about 100 KHz.

9. A surveillance system for detecting the presence in a controlled space of a miniature electromagnetic wave receptor-reradiator with signal mixing capability, said system comprising in combination a source of continuous microwave signals, means coupled to said source of microwave signals for propagating through said space an electromagnetic wave corresponding to said microwave signals, a first source of low frequency signals having a first average frequency, a second source of low frequency signals having a second average frequency different from said first average frequency, means coupled to said sources of low frequency signals for establishing respective wave fields corresponding to said low frequency signals through corresponding regions, each including said space, said low frequency signals having a sufficiently low frequency to enable the overlapping regions of said wave fields to be confined substantially to a smaller volume than said microwave signals, said smaller volume defining said space, signal detecting means, means for coupling said detecting means with said space for receiving signals therefrom, said detecting means being constructed and arranged to detect a third signal having an average frequency different from said first and second average frequencies and from harmonics thereof, said third signal being a modulation product resulting from mixing said first and second low frequency signals, and said detecting means detecting said third signal only when it is received as modulation on a carrier signal whose frequency bears a predetermined relationship to that of said microwave signals, and means coupled to said detecting means for providing an alarm responsive to detection of said third signal.

* * * * *

UNITED STATES PATENT AND TRADEMARK OFFICE

CERTIFICATE OF CORRECTION

PATENT NO. : 4,139,844
DATED : Feb. 13, 1979
INVENTOR(S) : Willes W. Reeder

It is certified that error appears in the above-identified patent and that said Letters Patent are hereby corrected as shown below:

On the cover sheet in item [73] "Deerfield" should read --Deerfield Beach--.

Column 2, line 26, "signal" should read --signals--.

Column 3, line 58, "transformer" should read --transformers--.

Column 4, line 47, "38" should read --37--.

Column 6, line 20, after "through" should be inserted --a--.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*